US008894727B2

(12) United States Patent
Berra et al.

(10) Patent No.: US 8,894,727 B2
(45) Date of Patent: Nov. 25, 2014

(54) HIGH OCTANE NUMBER COMPOSITION USEFUL AS FUEL FOR INTERNAL COMBUSTION AND CONTROLLED IGNITION ENGINE

(75) Inventors: Alessandra Berra, Grottaferrata (IT); Marco Buccolini, Camerino (IT); Gennaro Ferrante, Naples (IT)

(73) Assignee: Chimec S.p.A., Rome (IT)

( * ) Notice: Subject to any disclaimer, the term of this patent is extended or adjusted under 35 U.S.C. 154(b) by 76 days.

(21) Appl. No.: 13/511,127

(22) PCT Filed: Nov. 22, 2010

(86) PCT No.: PCT/IT2010/000464

§ 371 (c)(1), (2), (4) Date: May 23, 2012

(87) PCT Pub. No.: WO2011/061776

PCT Pub. Date: May 26, 2011

(65) Prior Publication Data

US 2012/0279112 A1 Nov. 8, 2012

(30) Foreign Application Priority Data

Nov. 23, 2009 (IT) ..... MI2009A2049

(51) Int. Cl.

| | |
|---|---|
| ***C10L 1/22*** | (2006.01) |
| ***C10L 1/222*** | (2006.01) |
| ***C10L 1/226*** | (2006.01) |
| ***C10L 1/228*** | (2006.01) |
| ***C10L 1/23*** | (2006.01) |
| ***C10L 1/223*** | (2006.01) |
| ***C10L 10/10*** | (2006.01) |
| *C10L 1/185* | (2006.01) |

(52) U.S. Cl.

CPC . *C10L 1/23* (2013.01); *C10L 1/223* (2013.01); *C10L 10/10* (2013.01); *C10L 1/1852* (2013.01)

USPC ..... 44/426; 44/413

(58) Field of Classification Search

USPC ..... 44/412, 413, 414, 416, 418, 426, 432, 44/433, 434; 508/131, 13, 507, 592; 585/1, 10, 13; 208/18, 19

See application file for complete search history.

(56) References Cited

U.S. PATENT DOCUMENTS 5,962,775 A * 10/1999 Liiva et al. ..... 73/35.02
2008/0134571 A1* 6/2008 Landschof et al. ..... 44/424

OTHER PUBLICATIONS

Database WPI, Week 197450, Thomas Scientific, London, GB; AN 1974-8612AV.

* cited by examiner

*Primary Examiner* — Pamela H Weiss
(74) *Attorney, Agent, or Firm* — Themis Law

(57) ABSTRACT

The present invention discloses a fuel composition useful for internal combustion engine having an Octane Number from 95 to 105 comprising:

Figure 1:
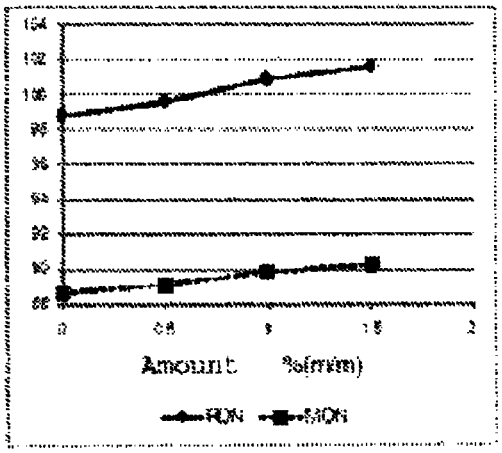

(a) an unleaded and devoid of organometal compounds base gasoline having an Octane Number (RON) from 90.1 to 103:

(b) one or more aromatic amines selected in the group consisting of:

(b1) 2,4-dialkylaniline, wherein the alkyl groups in position 2 and 4, independently one from the other, are selected in the group consisting of methyl, ethyl, n-propyl, iso-propyl, preferably both the alkyl groups in position 2 and 4 are methyl;

(b2) N-Nitrosodiphenylamine.

The process for preparing the above composition is also described along with the use of the aromatic amines selected between (b1) and (b2) and related mixtures for increasing the Octane Number.

5 Claims, 3 Drawing Sheets

HIGH OCTANE NUMBER COMPOSITION USEFUL AS FUEL FOR INTERNAL COMBUSTION AND CONTROLLED IGNITION ENGINE

The present invention relates to a fuel composition for internal combustion engine having an octane number (RON) from 95 to 105 comprising:

an unleaded and devoid of organometal compounds base gasoline having an octane number (RON) from 90.1 to 103 one or more aromatic amines selected from the group consisting of:

(b1) 2,4-dialkyl aniline, wherein the alkyl groups in position 2 and 4, independently one from the other, are selected in the group consisting of methyl, ethyl, n-propyl, iso-propyl, preferably both the alkyl groups in 2 and 4 position being methyl;

(b2) N-Nitrosodiphenylamine.

Aromatic amines (b1) and/or (b2) are present in such a quantity useful for increasing the base gasoline Octane Number at least of 0.2 RON values, usually from 0.05 weight % to 5.0 weight %, preferably from 0.1 weight % to 5.0 weight %.

The fuel composition of the present invention can be used as Super gasoline (RON=95) or as Super Plus gasoline (RON=98-100), or as a high Octane Number component to be mixed with lower octane quality component.

The present invention relates also to the use of amines (b1) and/or (b2) for increasing the Octane Number of gasoline for internal combustion engines comprising the addition of one or more aromatic amines selected in the above mentioned group to hydrocarbon fractions having both low Octane Number, let say an Octane Number from 60 to 90, and high Octane Number, let say an Octane Number from 90.1 to 103.

In relation to the Octane Number (ON), it can be determined either with the "Research" method (RON) according to ASTM D 2701 or ISO 5164, or with the "Motor" method (MON) according to ASTM 2700 or ISO 5163.

The above mentioned Octane Number value is one of the most important gasoline parameter, as it relates to power and fuel consumption of the engines fed with said gasoline. In fact, a high ON gasoline allows designing engines having a higher efficiency, generally by increasing the compression ratio.

In the past the gasoline octane value was improved by using additives, almost all based on lead. Usually Super gasoline was added with a lead-based organometal compound, mainly tetraethyl lead, able to achieve an Octane Number of 84-97, according to the requirements of current vehicle engines.

Current gasolines, the so-called green or unleaded gasolines and the so-called Super Plus gasolines, can get to Octane Number of 95 and 98-100 respectively, said values being required by modern engines having high performance or low fuel consumption. These gasolines, obtained by reformulation and/or by more severe production processes, are characterized by an increase in the aromatic compound content.

By consequence, addition of oxygen containing compounds is necessary, usually of petrochemical origin, methyl-t-butyl-ether being mainly used.

However, recent technical and environmental prescriptions have introduced or are being to introduce some limitation to aromatic and oxygenated compounds contained in gasoline.

In fact the use of aromatic compounds entails many drawbacks, like highly toxic emissions and excessive production of carbon residue in the combustion chamber, without considering that benzene, the simplest aromatic hydrocarbon, is a well-known carcinogenic compound.

In relation to the oxygenated compounds, they exhibit a high Octane Number, but the only product of this class commercially available is methyl-t-butyl-ether (MTBE).

In any case the oxygenated compounds can be utilized only within the limits prescribed by the standard for gasoline.

The norm EN 228, describing the requirements of gasoline utilized in the European Union, provides for the following limits of the oxygenated compounds: methanol <3%, isopropyl alcohol <10%, t-butyl alcohol <10%, ethers having 5 or more carbon atoms <15%, other oxygenated compounds <10%; moreover a further limit of oxygenated compounds in term of maximum allowed content of oxygen, i.e. 2.7%, is required.

As the mainly utilized oxygenated compound, let say MTBE, consequently its maximum limit is 15%, but in some countries this limit is reduced to 10%. Moreover some countries, as for example U.S.A. and Scandinavian countries, are taken into consideration the possibility to forbid, or they have already forbidden. the use of MTBE, for the reason that it is considered a potential water bed pollutant.

Moreover in the last years other restrictions for unleaded gasoline were introduced, one of them relating to the olefin hydrocarbons content. They are considered to cause the emission of particularly reactive exhausted hydrocarbons that are able to produce, once introduced in the atmosphere, harmful compounds both to the human healthy and to the environment. Consequently in Europe the maximum content of these olefin hydrocarbons is now less than 18% respect to the gasoline.

Other binding limits, generally prescribed in the existing standards, related to gasoline composition are those concerning the volatility (vapour pressure and some values of the distillation curve).

The most recent prescriptions derive also from the environmental need to reduce the so-called evaporation losses, causing introduction in the atmosphere of substantial amounts of volatile organic substances (Vacs). Obviously, such prescription concerns, in particular, gasoline distributed in the summer season and in warmer areas.

Finally, among the elements able to determine gasoline composition, it has to be mentioned that the RON and the MON values have to be balanced in a right way, in order to assure an appropriate and correct operation of the motors in whatever condition, i.e. at low speed and low load, as well at high speed and high load.

The combination of the two kinds of NO measures shows in the best way the on the road behaviour of the gasoline, when used in real engines.

The difference between RON and MON is called "sensitivity", exactly for meaning the gasoline sensitivity for contrasting the knocking phenomenon due to more severe operation condition. Currently 10 points sensitivity ($\Delta$RON-$\Delta$MON) is generally prescribed for every gasoline.

The need to reformulate gasoline derives not only from the change in the standard prescribed requirements, but also from the engine evolution. After the lead elimination from gasoline, a limited yet generalized reduction of the compression ratios was recognised, particularly in Europe, in order to allow using gasoline having a 95 ON, in terms of RON, lower than lead-based gasoline having a RON value 97 or 98.

The reason was the need to produce gasoline allowing minimizing the total refinery consumption related to gasoline production, and the fuel consumption of the vehicles.

However, more recently, octane requirements of vehicle engines have begun again to increase. This is essentially due to the introduction of electronic engine management systems, the so-called electronic control systems, which allow to extend the knock sensor use to essentially all the new vehicles. In case a motor vehicle is fed with a gasoline having an ON value lower than the octane requirement of the engine, this device detects any incipient knock problem and transmits a signal to the electronic control unit, which instantaneously reduces the spark advance for the running conditions, and prevents the combustion from going on under knock conditions.

Availability of these devices allows to optimize engine adjustment conditions with regard to the use of gasoline with a high Octane Number, usually with RON 98-100, ensuring high performances and low consumptions, yet at the same time allowing the engine vehicles to run in an acceptably way even when they are fed with gasoline having an ON lower than the optimal one. Of course, in that case output power will be lower and consumptions higher with respect to the optimal running conditions.

A further reason allows forecasting a tendency for the Octane Number to increase.

This reason derives from the need to even more reduce carbon dioxide emissions, in order to lower the well-known atmosphere overheating. In fact in some countries, for example in the European Union, the engine manufacturers are more and more constrained to maximum emission limits of this substance.

In this perspective, engines with higher compression ratios will be designed, so as to significantly reduce fuel consumption, of course in the case they are fed with gasoline having a right ON.

As it is well-known, the need to reduce the engine polluting emissions does not concern merely carbon dioxide. In fact, for other pollutants such as carbon oxide, un-burnt hydrocarbons and nitrogen oxides, this need dates much earlier. Therefore, engines have progressively fitted with even more sophisticated emission control devices and even more complex feeding systems, which have to be kept devoid of coking and uncontaminated by any fuel degradation product, so as to constantly operate with the utmost efficiency.

The evolution about gasoline and engines characteristics has caused an increased necessity for the refiners to adjust fuel composition. The usually carried out changes result in a current gasoline very different from the previous one, particularly referring to the period when lead-based additives improving the ON value were used. Moreover current gasoline is very different also from the first un-leaded gasoline. For example, as said before, average ON requirements increased from the 95 value, due to the progressive larger request of high ON gasoline, having RON 98 or 100.

From what has been illustrated in the foregoing, the problem to be solved is how to prepare a high Octane Number gasoline devoid of lead or other organometal compounds, having a low content of aromatic, ether and olefin compounds, able to satisfy norm EN 228, which describes the characteristics of the European Union gasoline, or other similar standards usually applied in the technologically more progressive countries.

The present invention provides a solution to the above described problems.

Aromatic amines are described in many patent applications as additives able to increase the Octane Number of both lead-based and unleaded gasoline.

We have now found that particular diamines are very effective for increasing the unleaded gasoline Octane Number, in an unexpected way, compared with structurally similar aromatic amines.

Thus, the present invention relates to a fuel composition useful for internal combustion engine having an Octane Number from 95 to 105 comprising:

(b) one or more aromatic amines selected from the group consisting of:

(b1) 2,4-dialkyl aniline, wherein the alkyl groups in position 2 and 4, independently one from the other, are selected in the group consisting of methyl, ethyl, n-propyl, iso-propyl; preferably alkyl;

(b2) N-Nitrosodiphenylamine.

Explosion engines are known also as internal combustion and controlled ignition engines. In any case the present invention relates to engines operating according to Otto cycle Aromatic amines (b1) and (b2) are present in an amount useful for increasing the gasoline Octane Number of at least 0.2 RON values, usually in an amount from 0.05% weight to 5% weight of the base gasoline, preferably from 0.1 to 5.0% weight.

The quantity of the aromatic amine will be related to the preset RON value of the final composition, taking into account the RON value of the base gasoline. By consequence a large quantity of aromatic amines results in a large increase of the RON value.

The fuel composition for internal combustion engines of the present invention can be used either as Super gasoline (RON=95) or as Super Plus gasoline (RON=98-100) or as a high octane fraction usable for mixing with one or more fraction having a lower RON value.

The above mentioned aromatic amines do not damage the anti-emission devices of the modern internal combustion engines.

In relation to the base gasoline, it consists of one or more hydrocarbon fraction obtained by means of different oil refining process or by the first oil distillation.

Typical but not limited examples of these gasolines are the unleaded modern gasolines, having RON from 90.1 to 97.9 and MON from 80 to 88, to be used in the most recent motors managed by an electronic system (for example those having an emission control named Euro III, Euro IV and Euro V).

Usually the base gasolines are obtained by blending in a proper way different hydrocarbon fractions deriving from refinery plants, taking into account its configuration.

Typical examples of hydrocarbon fractions useful, if blended in an appropriate way (well known to people skilled in the art), to produce the base gasolines of the present invention are:

Butane gas (mainly containing hydrocarbons having 4 carbon atoms);

Light gasoline from the first distillation (sometimes named "light naphtha");

Isomerate gasoline C5;

Isomerate gasoline C6;

Reformed gasoline (at a different severity grade in relation to the features of the final gasoline);

Gasoline from alkylation process;

Light gasoline from cracking process;

Gasoline from the first distillation (sometimes named "virgin naphtha" or "full range naphtha");

Natural gasoline (sometimes named "Condensate"), let say room temperature liquid hydrocarbons, present in petroleum gas produced directly at the oil well.

Moreover, base gasolines of the present invention can comprise also ethers, in particular MTBE.

The final gasolines can also contain minor amount of different additives, for example dyes, antifoaming agents, and other additives used on the final gasoline formulation. In any case the final gasolines of the present invention are in accord with the norm EN 228, which prescribes the features of the gasolines used in the European Union.

In particular the final gasolines of the present invention allow using base gasoline largely comprising refinery fractions obtained in less severe condition in comparison with those of the current Super and Super Plus gasolines. Consequently some advantages will come from that, as energy saving, easy control of process conditions, longer average plant life.

Besides, the final gasolines of the present invention present the improvement (see the experimental part) consisting in having a vapour pressure equal or lower than the base gasoline vapour pressure. In fact the addition of the aromatic amines of the present invention does not tend to increase the vapour pressure (VP) of the gasoline, as on contrary happens in the case of oxygenated compound addition, in particular MTBE, or of excessive amounts of light fractions having a high Octane Number.

We have to remember that the Vapour Pressure is a technical and legal standard of the gasoline and it must not to overcome specific values varying from a country to another, depending on the average temperature values during the year.

Frequently the VP increase is really the limiting factor to the addition of oxygenated compounds or light oil fractions having a high Octane Number, these methods representing the currently mainly used ways in order to increase gasoline Octane Number. Aromatic amines of the present invention do not present this drawback and their addition, in great amount too, does not cause an increase in VP.

In the experimental part (particularly in the tables) several base gasolines are reported, having different Octane Number, prepared by mixing different hydrocarbon fractions. It has to be noted that hydrocarbon compositions containing low amounts of 2,4-dimethylaniline and/or N-Nitrosodiphenylamine have an Octane Number definitely higher compared with the corresponding base gasoline.

The experimental part even shows that 2,4-dimethylaniline is much more efficient compared with compounds having a similar structure, as 2,3-dimethylaniline, 2,5-dimethylaniline, o-toluidine, N-methyl-2,4-dimethylaniline.

2,4-dimethylaniline is classified as CAS 95-68-1, while N-Nitrosodiphenylamine is classified as CAS 86-30-6.

The present invention relates also to a process for obtaining a fuel composition for internal combustion engines having an Octane Number from 95 to 105, said process comprising the addition to an unleaded and devoid of organometal compounds base gasoline having an Octane Number (RON) from 90.1 to 103, of one or more aromatic amine selected in the group consisting of:

(b1) 2,4-dialky aniline, wherein the alkyl groups in position 2 and 4, independently one from the other, are selected from the group consisting of methyl, ethyl, n-propyl, isopropyl;

(b2) N-Nitrosodiphenylamine.

The process of the present invention can be carried out by a very simple way, i.e. by direct mixing of the base gasoline with aromatic amines (b1) and/or (b2), for the reason that the two components are very miscible according to the amounts used in the preparation of the final gasoline.

As the base gasolines, they have been described above.

Aromatic amines (b1) and/or (b2) are added in a quantity able to increase the base gasoline Octane Number of at least 0.2 RON value, usually in a quantity from 0.05 weight % to 5.0 weight % with reference to the base gasoline, usually from 0.1% to 5.0 weight %.

The amount of aromatic amines in the final gasoline will be related to the RON target value starting from a base gasoline having a given RON value. Consequently, a larger increase in RON value needs a larger amount of aromatic amines.

The fuel composition of the present invention useful for internal combustion engines can be used as a Super gasoline (RON=95) or as Super Plus gasoline (RON=98-100) or as a high Octane Number composition to be further mixed with compositions having a lower Octane Number.

The present invention relates also to the use of aromatic amines selected in the group consisting of:

(b1) 2,4-dialkylaniline, wherein the alkyl groups in position 2 and 4, independently one from the other, are selected from the group consisting of methyl, ethyl, n-propyl, isopropyl, preferably the alkyl groups in 2 and 4 position being methyl;

(b2) N-Nitrosodiphenylamine, for increasing the Octane Number of base gasolines selected from the group consisting of:

(a1) base gasolines having a low octane number, i.e. having an Octane Number from 63 to 90;

(a2) base gasolines having a high octane number, i.e. having an Octane Number from 90.1 to 94.9;

the amines (b1) and/or (b2) being present in such a quantity to increase the Octane Number of at least 0.2 RON points in the case of base gasolines having a high Octane Number, at least 1.0 RON points in the case of base gasolines having a low Octane Number.

We have found that aromatic amines of the present invention (b1) and/or (b2) are able to increase the Octane Number not only of base gasolines having a high Octane Number, but also of base gasolines having a low Octane Number.

Gasolines useful for particular engines, intermediate or unfinished gasolines, in other words to be further mixed with high Octane Number compounds, will be obtained in the second case.

In the first case, high Octane Number gasolines will be obtained useful for more recent engines managed by an electronic system and having a great control of polluting emissions (for example Euro III, Euro IV and Euro V) and able to satisfy standard EN 228 or similar standards.

The following experimental examples clearly show the effectiveness of the amines (b1) and or (b2) in improving the Octane Number of different base gasolines.

For a better understanding of the present invention, the following examples are reported.

Figure 2:
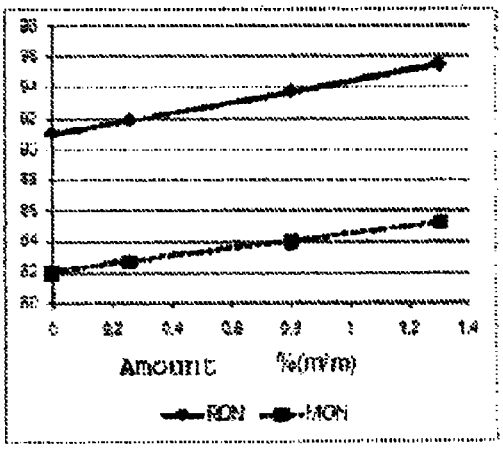
Figure 3:
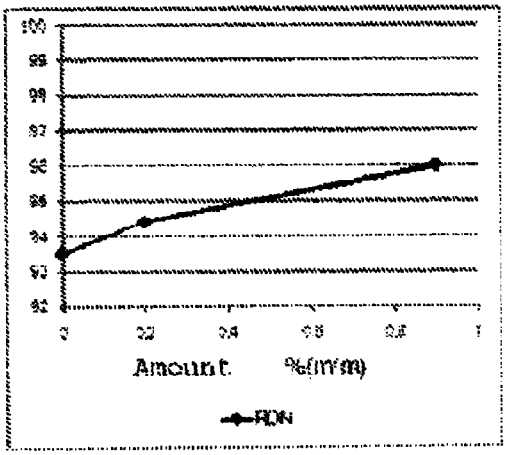
Figure 4:
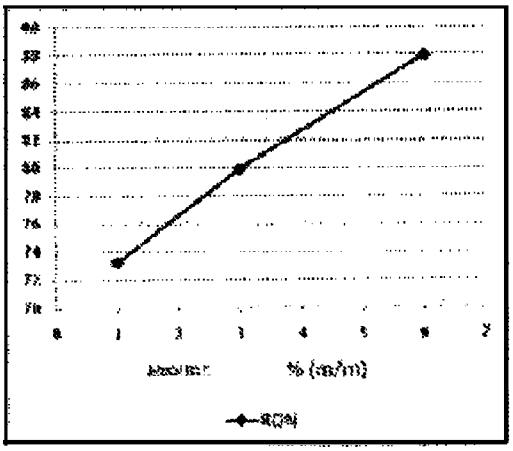
Figure 5:
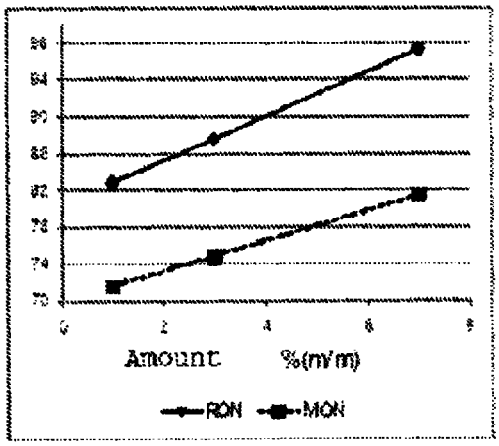
Figure 6:
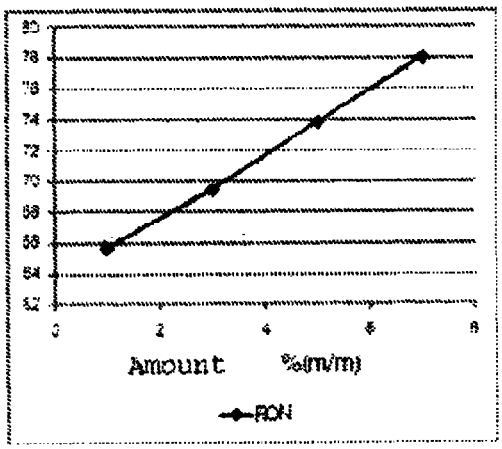
Figure 7:
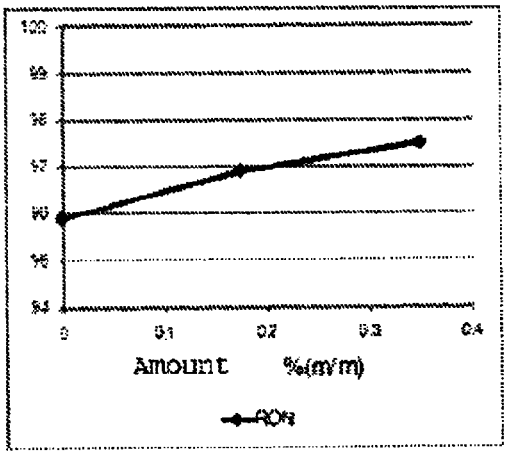
Figure 8:
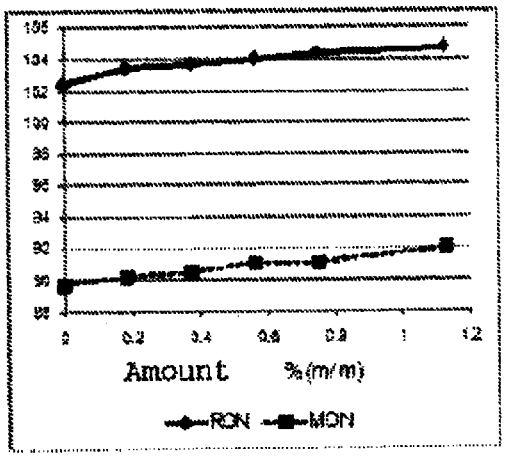
Figure 9:
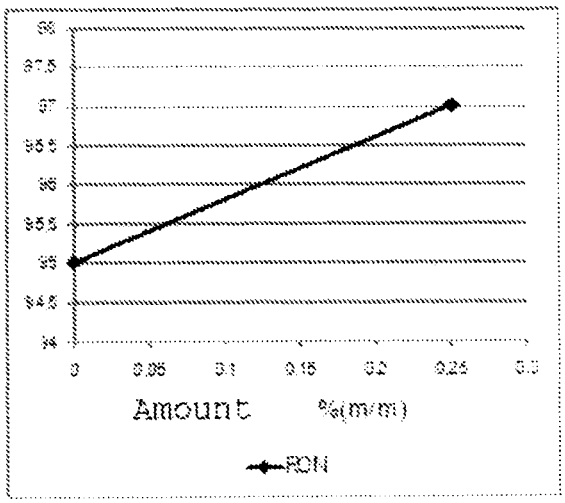

The enclosed graphs illustrate results obtained from the gasoline compositions described in the following examples. More specifically:

FIG. 1 plots data related to the composition of Example 1;
FIG. 2 plots data related to the composition of Example 2;
FIG. 3 plots data related to the composition of Example 3;
FIG. 4 plots data related to the composition of Example 4;
FIG. 5 plots data related to the composition of Example 5;
FIG. 6 plots data related to the composition of Example 6;
FIG. 7 plots data related to the composition of Example 7;
FIG. 8 plots data related to the composition of Example 8;
FIG. 9 plots data related to the composition of Example 9.

EXAMPLES

A series of gasolines, consisting of real components obtained from different refinery plants, has been added with different amounts of the aromatic amines of the present invention.

The so obtained samples were evaluated by performing RON and MON measures, according to methods ISO 5164 (ASTM D 2699) and ISO 5163 (ASTM D 2700).

Example 1

A high Octane Number unleaded gasoline, to be used with recent engines managed by an electronic system, having the following features and compositions:

| Gasoline Features | | |
|---|---|---|
| RON | | 98.8 |
| MON | | 88.7 |
| Density | $kg/m^3$ | 765 |
| **Distillation** | | |
| % Evap. 70° C. | % (v/v) | 24 |
| % Evap. 100° C. | % (v/v) | 65 |
| % Evap. 150° C. | % (v/v) | 89 |
| Final Point | | 199 |
| Vapor Pressure | kPa | 69 |
| Oxydation Stability | minutes | 360 |
| Sulfur Content | mg/kg | 7 |
| Benzene Content | % (v/v) | 0.5 |
| Oxygen Content | % (m/m) | 2 |
| **Hydrocarbons** | | |
| Aromatic | % (v/v) | 32 |
| Olefin | % (v/v) | 10 |
| **Composition (Streams)** | | |
| Butanes | % (v/v) | 3 |
| Reformed | % (v/v) | 49 |
| Naphtha from Cracking | % (v/v) | 27 |
| Alkylated | % (v/v) | 10 |
| MTBE | % (v/v) | 11 |

was blended with increasing amounts of 2,4-dimethyl aniline. Related results are reported in Table 1 and in FIG. 1.

Therefore it has been verified that 2,4-dimethylaniline allows to greatly increase the Octane Number, both in terms of RON and in terms of MON, of high Octane Number gasolines, also in presence of a high concentration of oxygenated components (MTBE).

From the above results, it is evident that a 500 ppm quantity of 2,4-dialkylaniline gives rise to an increase of final gasoline RON value of almost 1 RON point and, at least, of 0.4 MON points.

A number of amines of the same chemical group, used in the same way as additive for increasing Octane Number, are not so effective in comparison with 2,4-dimethylaniline (see Table 1a).

In particular, Table 1a reports data related to four aromatic amines structurally similar to 2,4-dimethylaniline. The addition of these amines to the same gasoline in the same quantity (500 ppm) leads to an increase in RON and MON very lower compared with 2,4-dimethylaniline.

Example 2

A high Octane Number unleaded gasoline, to be used with recent engines managed by an electronic system, having the following features and composition:

| Gasoline features | | |
|---|---|---|
| RON | | 91 |
| MON | | 82 |
| Density | $kg/m^3$ | 0.75 |

-continued

| Distillation | | |
|---|---|---|
| % Evap. 70° C. | % (v/v) | 24 |
| % Evap. 100° C. | % (v/v) | 60 |
| % Evap. 150° C. | % (v/v) | 83 |
| Final Point | | 190 |
| Vapor Pressure | kPa | 53 |
| Oxydation stability | minuti | 385 |
| Sulphur Content | mg/kg | 7 |
| Benzene Content | % (v/v) | 0.5 |
| Oxygen Content | % (m/m) | 0 |
| **Hydrocarbons** | | |
| Aromatic | % (v/v) | 38 |
| Olefin | % (v/v) | 6 |
| **Composition (Streams)** | | |
| Isomerate | % (v/v) | 41.5 |
| Reformed | % (v/v) | 55.5 |
| Condensate | % (v/v) | 3.0 |

was blended with increasing amounts of 2,4-dimethylaniline. The results are reported in Table 2 and FIG. 2.

Also the addition to this gasoline, having an Octane Number not particularly high, of a 1% quantity of 2,4-dimethylaniline allows to obtain a RON increase of about 3 points and a MON increase of more than 2 points. Table 2 also reports the Vapor Pressure values (VP) of a non-blended gasoline and a gasoline blended with 0.8% of 2,4-dimethylaniline. It can be noted that the addition of the amine does not tend to increase the gasoline VP. On the contrary it is known that blending of oxygenated compounds (MTBE) causes a VP increase.

The Vapor Pressure is considered a technical and legal standard of the gasoline and it must not to overcome some specific values varying from a country to another, depending on the average temperature values during the year.

Frequently the VP increase is really the limiting factor to the addition of oxygenated compounds, they representing the currently mainly used way in order to increase gasoline Octane Number. Aromatic amine of the present invention do not present this drawback and its blending, in great amount too, does not cause an increase in VP.

Example 3

A high Octane Number unleaded gasoline, to be used with recent engines managed by an electronic system, having the following features and composition:

| Composition (Streams) | | |
|---|---|---|
| Isomerate | % (v/v) | 41.5 |
| Reformed | % (v/v) | 55.5 |
| Condensate | % (v/v) | 3.0 |

is blended with increasing amounts of 2,4-dimethylaniline. Related results are reported in Table 3 and FIG. 3.

Usually the hydrocarbon fraction coming from the Isomerisation plant (named Isomerate) is used into the refinery plant in order to increase the Octane Number of gasolines, without increasing the aromatic hydrocarbon content. However this fraction is not always available in a quantity necessary to ensure the respect of requirements related to the Octane Number.

The above results show that a quantity equal to 0.5% of 2,4-dimethylaniline is able to increase the RON value of 1.5 points. A 1% addition allows to obtain a RON increase of about 3 points. Therefore the use of this additive can aid the refinery plant allowing it not to give up a high Octane Number.

It has to be noted that 2,4-dimethylaniline addition does not involve a Vapor Pressure increase, better still the Vapor Pressure is reduced by increasing the additive concentration.

Example 4

A low Octane Number gasoline (RON=69.4), totally consisting of a first distillation gasoline named "virgin naphtha" or "full range naphtha", is blended with increasing amounts of 2,4-dimethylaniline.

These gasolines almost totally contain linear chain saturated hydrocarbons and then are characterized by relatively low Octane Number.

The obtained results are reported in Table 4 and FIG. 4.

Example 5

A low Octane Number gasoline having the following features and composition:

| Gasoline features | | |
|---|---|---|
| RON | | 80 |
| MON | | 69.5 |
| Density | kg/m$^3$ | 755 |
| **Distillation** | | |
| % Evap. 70° C. | % (v/v) | 8 |
| % Evap. 100° C. | % (v/v) | 39 |
| % Evap. 150° C. | % (v/v) | 94 |
| Final Point | | 178 |
| Vapor Pressure | kPa | 30.1 |
| Oxydation Stability | Minuti | |
| Sulphur Content | mg/kg | |
| Benzene Content | % (v/v) | |
| Oxygen Content | % (m/m) | |
| **Hydrocarbons** | | |
| Aromatic | % (v/v) | 30 |
| Olefin | % (v/v) | 1 |
| **Composition (Streams)** | | |
| Reformed | % (v/v) | 92 |
| Light Virgin Naphtha | % (v/v) | 8 |

is blended with increasing amounts of 2,4-dimethylaniline. The related results are reported in Table 5 and FIG. 5.

Example 6

A low Octane Number gasoline (RON=63.0), completely consisting of natural gasoline (sometimes named "condensate", i.e. liquid at room temperature hydrocarbons, contained in the natural gas directly extracted from the wells), is blended with increasing amounts of 2,4-dimethylaniline.

Also these gasolines almost totally consist of linear chain saturated hydrocarbons and then are characterized by relatively low Octane Number.

Related results are reported in Table 6 and FIG. 6.

As above shown, an additive blending of 5% allows to obtain a RON increase of about 8 points.

Different amines structurally similar to 2,4-dimethylaniline have been tested too.

Table below (Table 6A) lists four amines structurally similar to 2,4-dimethylaniline that cause, when blended in an amount of 5%, a noticeably lower increase of RON and MON.

Example 7

N-Nitrosodiphenylamine has been evaluated in presence of modern unleaded gasolines, to be used with recent engines managed by an electronic system, having the following features:

| Gasoline features | | |
|---|---|---|
| RON | | 95.9 |
| Density | kg/m$^3$ | 0.74 |
| **Distillation** | | |
| % Evap. 70° C. | % (v/v) | 25 |
| % Evap. 100° C. | % (v/v) | 65 |
| % Evap. 150° C. | % (v/v) | 84 |
| Final Point | | 193 |
| Vapor Pressure | kPa | 69 |
| Oxydation stability | min' | 400 |
| Sulphur Content | mg/kg | 8 |
| Benzene Content | % (v/v) | 0.5 |
| Oxygen Content | % (m/m) | 1.5 |
| **Hydrocarbons** | | |
| Aromatic | % (v/v) | 35 |
| Olefin | % (v/v) | 6 |

In some cases this amine allows a RON and MON increase (Table 7 and Graph 7) better than 2,4-dimethylaniline (greater efficiency).

It can be observed that following the blending of a small quantity of N-Nitrosodiphenylamine, <just 0.33%, the gasoline Octane Number increases of more than 1.5 points.

Using the same gasoline, 2,4-dimethylaniline does not allow obtaining the same performance (0.5% blending causes a RON increase of less than 1 point).

Example 8

A high Octane Number unleaded gasoline, to be used with recent engines managed by an electronic system, having the following features:

| Gasoline features | | |
|---|---|---|
| RON | | 102.4 |
| MON | | 89.7 |
| Density | kg/m$^3$ | 750 |

has been blended with increasing amounts of N-Nitrosodiphenylamine. The related results are reported in Table 8 and FIG. 8.

Example 9

An unleaded gasoline to be used with recent engines managed by an electronic system having the following features:

| Gasoline features | | |
|---|---|---|
| RON | | 95 |
| Density | kg/m$^3$ | 0.73 |

-continued

| Distillation | | |
|---|---|---|
| % Evap. 70° C. | % (v/v) | 28 |
| % Evap. 100° C. | % (v/v) | 64 |
| % Evap. 150° C. | % (v/v) | 80 |
| Final Point | | 199 |
| Vapor Pressure | kPa | 70 |
| Oxydation Stability | min' | 380 |
| Sulphur Content | mg/kg | 6 |
| Benzene Content | % (v/v) | 8 |
| Oxygen Content | % (m/m) | 1.5 |
| **Hydrocarbons** | | |
| Aromatic | % (v/v) | 30 |
| Olefin | % (v/v) | 7 |

has been blended with increasing amounts of N-Nitrosodiphenylamine. The related results are reported in Table 9 and FIG. 9.

The invention claimed is:

1. A gasoline product for internal combustion engines having a Research Octane Number from 95 to 105 comprising:

(a) an unleaded and devoid of organometal compounds base gasoline having a Research Octane Number (RON) from 90.1 to 103; and (b) N-Nitrosodiphenylamine.

2. The gasoline product according to claim 1, wherein the N-Nitrosodiphenylamine is present in a quantity sufficient to increase the base gasoline octane number by at least 0.2 RON points.

3. The gasoline product according to claim 1, wherein the N-Nitrosodiphenylamine is present in a quantity from 0.05% by weight to 5.0% by weight with reference to the base gasoline.

4. The gasoline product according to claim 1, wherein the base gasoline comprises hydrocarbon fractions selected from the groups consisting of:

butane gas;

light gasoline from first distillation, or light naphtha;

isomerate gasoline C5;

isomerate gasoline C6;

reformed gasoline, at a different severity grade in relation to the characteristics of the final gasoline;

gasoline from an alkylation process;

light gasoline from a cracking process;

gasoline from the first distillation, or full range naphtha; and natural gasoline.

5. The gasoline product according to claim 1, wherein the base gasoline contains one or more ethers.

* * * * *